United States Patent [19]

Mazza et al.

[11] Patent Number: 5,015,916

[45] Date of Patent: May 14, 1991

[54] ELECTRIC DISCHARGE LAMP AND THERMAL SWITCH STARTER MEANS THEREFOR

[75] Inventors: Lawrence T. Mazza, Mayfield Heights; Raymond A. Heindl, Euclid, both of Ohio

[73] Assignee: General Electric Company, Schenectady, N.Y.

[21] Appl. No.: 452,472

[22] Filed: Dec. 18, 1989

[51] Int. Cl.[5] ..... H05B 41/06

[52] U.S. Cl. ..... 315/47; 315/60; 315/73

[58] Field of Search ..... 315/47, 60, 73, 100, 315/104

[56] References Cited

U.S. PATENT DOCUMENTS 3,965,387 6/1976 Stuart et al. ..... 315/47

*Primary Examiner*—David Mis

*Attorney, Agent, or Firm*—George E. Hawranko; John P. McMahon; Stanley C. Corwin

[57] ABSTRACT

An electric discharge lamp is disclosed utilizing an improved thermally responsive switch for operation of an auxiliary starting electrode. The improved switch has a more compact structural configuration which further accommodates temperature excursions beyond the design closure temperature without exceeding elastic limits of the metals employed in the switch construction. A metal halide lamp of relatively compact construction which employs the improved switch is also disclosed.

13 Claims, 1 Drawing Sheet

Fig. 1
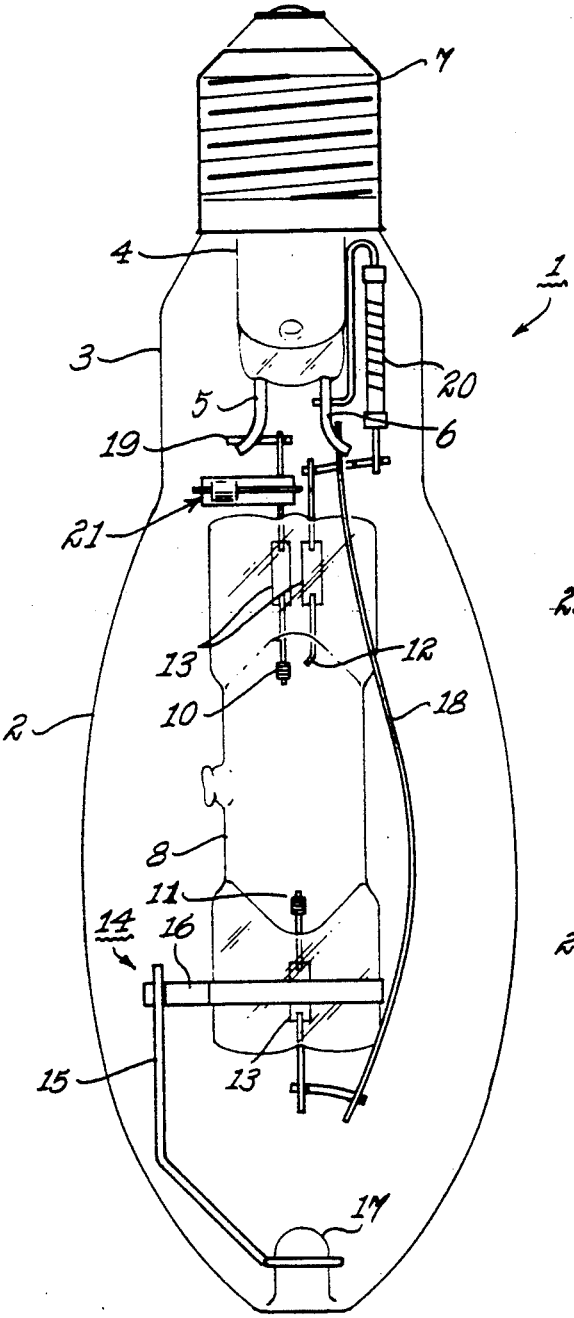
Fig. 2
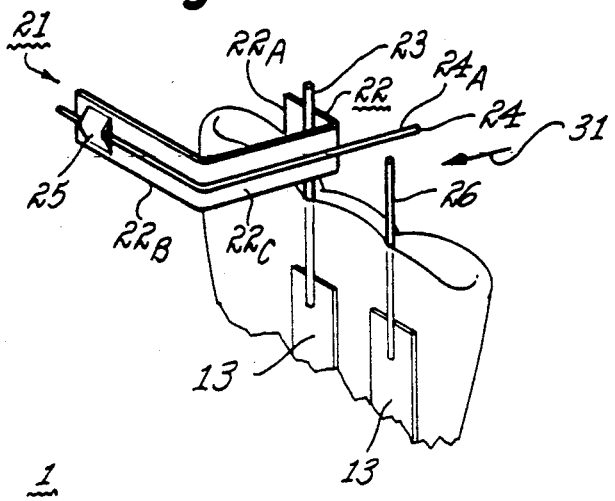
Fig. 3(a)
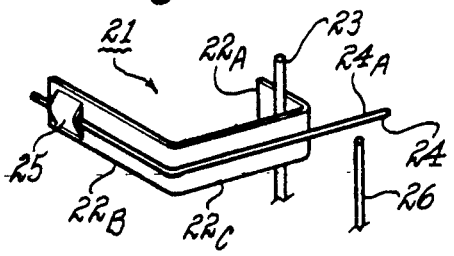
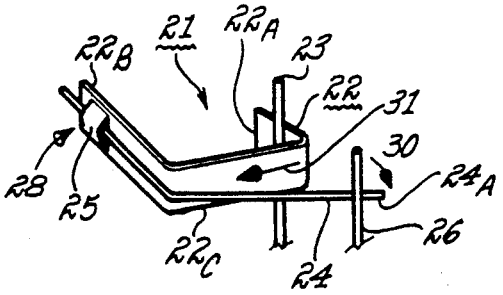
Fig. 3(b)

ELECTRIC DISCHARGE LAMP AND THERMAL SWITCH STARTER MEANS THEREFOR

BACKGROUND OF THE INVENTION

This invention relates generally to an improved construction of an electric discharge lamp, and more particularly to an electric discharge lamp having auxiliary starting electrode means which includes a more compact thermal switch configuration.

Thermally responsive switch devices are now commonly employed in electric discharge lamps to operate a starting electrode when voltage is initially applied to the lamp. In a typical lamp device, the starting electrode is electrically connected through a resistor to one main lamp electrode physically located at an opposite end of the arc tube so that upon voltage application to the lamp there is caused a high electrical field to be generated between the starting electrode and the other main electrode located adjacent thereto. A glow discharge results thereat followed by formation of the principal lamp discharge between the two main lamp electrodes. The starting electrode serves no further purpose after formation of the principal lamp discharge in a representative metal halide discharge lamp employing such starting means and is commonly short-circuited with respect to the operatively associated adjacent main electrode in order to avoid any significant voltage gradient therebetween which would otherwise deleteriously effect lamp performance such as by removing vaporized constituents from the principal lamp discharge which, in turn, would lead to lamp seal failures. A normally open bimetal switch device is now employed in the above defined lamp operation which is electrically connected to the power source and to the adjacent main lamp electrode. This switch device closes from heat generated by the arc tube while opening when the lamp has been turned off. A more detailed explanation upon both construction and operation of such type discharge lamp is found in U.S. Pat. No. 3,965,387, of Stuart et al. which is assigned to the assignee of the present invention and is herein incorporated by reference. As therein disclosed, such thermal switch means are often used in high intensity discharge lamps wherein they are physically located within the annular space between an inner arc tube formed with fused silica or other refractory glass material and an outer light transmissive envelope also generally formed with a glass material.

The particular bimetal switch device disclosed in the above referenced patent employs a bent strip of the bimetal physically secured at one end to inlead means for one main electrode while having a spring-like conductor secured at the opposite end for engagement with inlead means of the auxiliary electrode. The conductor element thereof is arranged to proceed in a direction along a surface of the bimetal strip and to project forwardly therefrom for engagement with the auxiliary electrode inlead means when thermally actuated. Spring-like flexibility of this conductor element accommodates temperature excursions beyond generally anticipated switch design closure temperatures with the springy conductor temporarily distorting so as to avoid any significant deformation of the bimetal material beyond its elastic limit. Another bimetal switch device now employed in commercial discharge lamps of this type features a bent bimetal strip having right angle bent portions at each end but wherein physical joinder of the bimetal strip to fixed inlead means of the main electrode occurs approximately at a midpoint in the bimetal strip.

Recent discharge lamp developments include a trend toward using smaller sized outer lamp envelopes with existing size arc tubes. Consequently, the annular free space available for lodging lamp components has been significantly reduced making it desirable to have a more compact thermal switch component configuration for utilization therein. Simply reducing the physical size of the above described bimetal switch devices with a shorter bimetal strip is unproductive since the shorter strip will not bend as far and as a result, reliable closure contact may not occur if the bimetal receives insufficient heat from the arc tube under certain lamp operating conditions. Accordingly, it now becomes desirable to improve the configuration of a thermal switch for utilization in more compact type discharge lamps such that the switch device occupies less space in the lamp yet still operates in a reliable manner.

It is an object of the present invention therefore to provide an improved thermal switch configuration particularly adapted for more compact discharge lamp utilization.

It is another object of the present invention to provide an improved thermal switch configuration of more compact design which also tolerates large excursions beyond the temperatures anticipated that the closure of the switch is to be subjected.

Still a different object of the present invention is to provide a more compact thermal switch device employing a thermally deformable metal element wherein substantially the entire length of the element is caused to bend for improved device actuation. These and still further objects of the present invention will become apparent upon considering the following detailed description of the present invention.

SUMMARY OF THE INVENTION

A novel structural configuration has been discovered for a thermal switch device which is now shorter in overall length than the prior art devices while still employing the same length of thermally deformable metal. More particularly, the presently improved thermal normally open switch device employs a thermally deformable metal strip bent so that it is shorter in overall length yet incorporates the same length of metal previously employed in the prior art bent strip elements. Generally, an improved thermal switch device according to the present invention employs a thermally deformable bent metal strip, which can be of conventional bimetal, that may have a first or bent portion at one end for joinder to fixed inlead means of a lamp main electrode when installed and has a second or bent portion at the opposite end having a flexible conductor physically joined thereto. The flexible conductor runs along substantially the entire second portion, runs along the middle portion of the metal strip, and projects forwardly of the first portion so as to engage fixed inlead means of the lamp auxiliary electrode. An alternative configuration is to have the bimetal attached to the auxiliary electrode lead and engaging main electrode lead.

An electric discharge lamp employing such improved normally open switch device comprises: (a) an outer light transmissive envelope, (b) an inner arc tube having electrodes at opposite ends including at one end a main electrode and an auxiliary starting electrode both connected to inleads hermetically sealed at a pinch seal region, and (c) a thermal switch within said outer envelope. The thermal switch comprises a thermally deformable bent metal strip having a first portion at one end physically joined to inlead means of either one main electrode or the the auxiliary electrode and a second or bent portion at the opposite end having a flexible conductor physically joined thereto. The flexible conductor first runs along a surface of substantially the entire second portion, secondly runs along the surface of a middle portion of the metal strip, and then projects forwardly of the first bent portion so as to engage inlead means of the auxiliary electrode and form a short circuit between the main and auxiliary electrodes upon switch closure. The flexible conductor is moved in response to thermal deformation of substantially the entire length of the bent metal strip.

Switch operation proceeds according to the present invention with the flexible conductor element of the switch device being spaced apart from the auxiliary electrode inlead while the lamp is at ambient temperature. Such normally open switch position remains until the lamp discharge starts whereupon said conductor element is caused to deflect by deformation of the thermally deformable metal strip which occurs upon heating. Continued movement of the conductor element in the same direction finally produces electrical contact with the auxiliary electrode inlead thereby closing the switch and forming an electrical short circuit between the operatively associated pair of main and auxiliary electrodes. In a preferred embodiment, construction of the thermally deformable metal strip with a conventional bimetal produces an arcuate deformation path similar to that disclosed in the FIGS. 3–5 of the previously referenced 3,965,387 patent. It should be noted in connection with the operation of the present switch embodiment that movement of the conductor element is caused by a thermal deformation taking place over substantially the entire length of the bent metal strip.

BRIEF DESCRIPTION OF THE DRAWINGS

FIG. 1 is a side view depicting one embodiment for a compact size metal halide lamp provided with a thermal switch embodying the present invention.

FIG. 2 is an enlarged perspective view for the switching means being utilized in the lamp of FIG. 1.

FIG. 3(*a*) illustrates the at rest or open position of the thermal switch, whereas, FIG. 3(*b*) illustrates the operative or closed position of the thermal switch.

DETAILED DESCRIPTION OF THE PREFERRED EMBODIMENTS

Referring to the drawings, there is depicted in FIG. 1 an improved metal halide type discharge lamp 1 in which the invention may be embodied comprising an outer vitreous envelope or jacket 2 of bulged tubular or elliptical form having a neck portion 3 closed by a reentrant stem 4. Stiff inlead wires 5 and 6 extending through the stem are connected at their outer ends to the contacts of a screw base 7 and have connections from their inner ends to an inner arc tube 8. The arc tube is preferably formed with fused silica and has sealed therein at opposite ends main arc electrodes 10 and 11 along with an auxiliary starting electrode 12. The electrodes are supported on inleads which include intermediate thin molybdenum foil sections 13 hermetically sealed through the flattened or pinch seal ends of the arc tube. The arc tube is further partially supported within the outer envelope by a metal mount 14 having a longitudinally extending support rod 15 attached to a metal strap 16 which clamps about a pinch end of the arc tube. The dome end of said mount part is restrained in the outer envelope with an inverted nipple 17. Main electrode 11 is connected to inlead 6 by a curved wire 18, whereas, main electrode 10 is connected to inlead 5 by member 19. Starting electrode 12 is connected to inlead 6 through a current limiting resistor element 20. In compact type metal halide lamps corresponding to that illustrated and produced commercially by applicants' assignee, the arc tube contains argon at a pressure of about 25 torr, a quantity of mercury substantially vaporized during operation and exerting a partial pressure of one to fifteen atmospheres. The arc tube further contains a quantity of sodium iodide as the halide substance in excess of that vaporized at the operating temperature, along with a smaller amount of scandium iodide. Alternatively, the arc tube may contain sodium iodide, scandium iodide and thorium iodide. The outer envelope or jacket is filled with an inactive gas, suitably nitrogen at about one-half atmospheric pressure.

The present invention relates to a particular structural configuration for thermal switch 21 which short-circuits auxiliary electrode 12 to main electrode 10 after the lamp is warmed up. Such short-circuiting manner of lamp operation is further described in the above referenced 3,965,387 patent to include still other teachings referred to therein. Accordingly, FIG. 2 of the present invention represents an enlarged perspective view of the switch device 21 as employed in the FIG. 1 lamp embodiment together with the lamp inlead means which cooperate for switch operation. As seen in FIG. 2, switch 21 comprises a bimetal strip 22 preferably shaped to have a first right angle bent portion 22A at one end physically joined to lamp inlead 23 (which is connected to main electrode 10) and has a second or bent right angle portion 22B at the opposite end. The portion 22A is preferably bent so as to assist in its connection to inlead 23 but may have other shapes that accommodate the mating to inlead 23. The portions 22A and 22B are connected by a middle portion 22C.

A flexible conductor 24 is physically joined to the bimetal strip at distal end of the second bent portion 22B at location 25 by conventional means such as welding, brazing or crimping. The flexible conductor 24 runs along substantially the entire length of the second bent portion 22B, along the middle portion 22C and then projects forwardly of the first bent portion 22A as portion 24A.

The bimetal strip 22 may be formed of nickel-iron alloy and nickel-chrome steel alloy. The flexible conductor 24 may be of a metal consisting of tungsten and molybdenum. For the embodiment illustrated in FIG. 2 the flexible conductor 24 may encounter a bending action so as to move about 1 mm to about 5 mm from its at rest position.

The bimetal strip 22 may have an effective length unbent in the range of 10 to 30 mm which without the benefits of the present invention would hinder if not prevent its insertion into the confines of the lamps contemplated by this invention. The present invention by placing a bent portion 22B into the bimetal strip reduces its overall length to allow insertion into a compact lamp while at the same time providing motion of the flexible conductor 24 nearly as large as that provided by an unbent bimetal strip 21 having the same total length of bimetal material. In one embodiment, the active length of the bimetal strip 21 is equally divided between the second bent portion 22B and the middle portion 22C. This configuration results in a motion of the flexible contact 22B approximately 80% as large as that of an unbent bimetal of the same active length, yet the overall length of the bent configuration is substantially less than half that of the unbent configuration. The bent portion 22B of the bimetal produces a small amount of axial travel (arrow 31 shown in FIG. 2) of the end of the flexible conductor 24, in addition to the lateral travel. This axial travel produces a wiping action of the flexible conductor against the arc tube inlead, which may assist in obtaining consistently good contact between the two leads when the switch closes. The improved bending action of bimetal strip 22 having conductor 24 attached thereto may be described with reference to FIGS. 3(*a*) and 3(*b*).

FIG. 3(*a*) shows the at rest condition of the bimetal strip 22 and flexible conductor 24. The flexible conductor element 24 of the switch device 22 is spaced apart from the auxiliary electrode inlead 26 at its at rest condition while the lamp is at ambient temperature. Such a normally open switch position remains until voltage is applied to the lamp. The voltage initiates operation of the lamp which creates heat to cause the bimetal strip 22 to bend in a clockwise direction 28 as shown in FIG. 3(*b*) which, in turn, causes the flexible conductor to rotate in a clockwise direction 28 also shown in FIG. 3(*b*). The rotation of conductor 24 causes its outer portion 24A to firmly contact and engage the auxiliary electrode in lead 26. The engagement of conductor 24 short-circuits the inlead of the main electrode 10 to the auxiliary electrode 12.

At the design closure temperature of the switch 21, the flexible conductor 24 contacts the opposite electrode inlead. If the temperature of the bimetal rises beyond this point, strip 22 deflects further, causing the flexible conductor 24 to bend, thereby preventing or relieving the stress on the bimetal strip 22 from exceeding its elastic limit which may otherwise cause damage. In addition, once the flexible conductor 24 contacts the opposite electrode inlead, further deflection of the bimetal strip 22, and specifically the second bent portion 22B of the strip, causes the flexible conductor to move in an axial direction 31, producing a wiping action between the contact surfaces which improves the long-term reliability of the contact between the flexible conductor 24 and the electrode inlead 26.

It will be apparent from the foregoing description that generally improved thermally responsive switch means have been provided enabling a more compact size construction for high intensity arc discharge lamps. It is contemplated that modifications can be made in the lamp configurations herein illustrated, however, without departing from the spirit and scope of the present invention. For example, these lamps may employ other already known base end constructions, arc tube support means, lamp outer envelope shapes and sizes, specialized ballasting circuits and still other lamp variations. Consequently, it is intended to limit the present invention only by the scope of the appended claims.

What we claim as new and desire to secure by Letters Patent of the United States is:

1. An electric discharge lamp comprising:

(a) an outer light transmissive envelope, (b) an inner arc tube having electrodes at opposite ends including at one end a main electrode and an auxiliary starting electrode connected to inleads hermetically sealed at a pinch seal region and a thermal switch within said outer envelope, (c) the thermal switch comprising a thermally deformable bent metal strip having a first portion at one end physically joined to inlead means of one main electrode and a second bent portion at the opposite end, said first and second portions being joined by a middle portion, said second bent portion having a flexible conductor physically joined thereto, said flexible conductor running along substantially the entire second portion, further running along the middle portion, and then projecting forwardly of the first portion to engage inlead means of the auxiliary electrode for a short circuit between said main and auxiliary electrodes upon switch closure, and (d) the conductor being moved responsive to thermal deformation by substantially the entire length of the bent metal strip.

2. The lamp of claim 1 wherein the conductor is moved in a direction caused by arcuate deformation of said bent bimetal strip.

3. The lamp of claim 1 wherein said first portion has a bent shape to accommodate the joinder to said inlead means.

4. The lamp of claim 1 wherein both said first and second portions of the metal strip form substantially right angles relative to said middle portion.

5. The lamp of claim 1 wherein the outer envelope is gas filled while the inner arc tube includes an inert gas fill further containing a halogen substance.

6. A normally open thermal switch having a compact structural configuration for an electric discharge lamp comprising:

(a) a thermally deformable metal strip having a first portion at one end for physically joining to fixed inlead means of a first lamp electrode and a second bent portion at the opposite end, said first and second portions being joined by a middle portion, said second bent portion having a flexible conductor physically joined thereto, said flexible conductor running along substantially the entire second portion, further running along the middle portion and then projecting forwardly of the first portion for engagement with fixed inlead means of a second lamp electrode upon the closure operation of said thermal switch, and (b) the conductor being moved responsive to thermal deformation by substantially the entire length of the bent metal strip.

7. The switch of claim 6 wherein the conductor is moved in a direction caused by arcuate deformation of a said metal strip.

8. The switch of claim 6 wherein said first portion has a bent shape to accommodate the joinder to said inlead means.

9. A normally open thermal switch having a compact structural configuration for an electric discharge lamp and permitting temperature excursions beyond design closure temperature comprising:

(a) a thermally deformable bent metal strip having a first portion at one end physically joined to fixed inlead means of a first lamp electrode with a second bent portion at the opposite end, said first and second portions being joined by a middle portion, said second bent portion having a flexible conductor physically joined thereto, said flexible conductor running along substantially the entire second bent portion, further running along the middle portion, and then projecting forwardly of the first portion for engagement with fixed inlead means of a second lamp electrode upon the switch closure operation of said thermal switch, (b) the conductor being moved responsive to thermal deformation by substantially the entire length of the bent metal strip, and (c) the flexible conductor absorbing by distortion after engagement with said second lamp electrode inlead means any excess deformation of the bent metal strip caused by a temperature excursion beyond design closure temperature so that neither said bent metal strip nor said flexible conductor becomes stressed beyond elastic limit.

10. The switch of claim 9 wherein the conductor is moved in a direction caused by arcuate deformation of said metal strip.

11. The switch of claim 9 wherein said first portion is bent to accommodate joinder to said inlead means.

12. The switch of claim 9 wherein said flexible conductor is moved axially against arc tube lead in response to the thermal deformation of said bent metal strip.

13. The switch of claim 10 wherein such movement of said conductor results in a wiping action between said conductor and said fixed inlead means.

* * * * *